US012467240B2

(12) United States Patent
McCaffrey

(10) Patent No.: US 12,467,240 B2
(45) Date of Patent: Nov. 11, 2025

(54) GEOMETRIC PROFILE FOR IMPROVED MANUFACTURABILITY OF A GROUND ENGAGING TOOL

(71) Applicant: Caterpillar Inc., Peoria, IL (US)

(72) Inventor: Brandon Hammig McCaffrey, St. Louis, MO (US)

(73) Assignee: Caterpillar Inc., Peoria, IL (US)

( * ) Notice: Subject to any disclaimer, the term of this patent is extended or adjusted under 35 U.S.C. 154(b) by 239 days.

(21) Appl. No.: 17/671,867

(22) Filed: Feb. 15, 2022

(65) Prior Publication Data

US 2023/0257970 A1 Aug. 17, 2023

(51) Int. Cl.
*E02F 9/28* (2006.01)

(52) U.S. Cl.
CPC ..... *E02F 9/2883* (2013.01); *E02F 9/2858* (2013.01); *E02F 9/28* (2013.01); *E02F 9/2808* (2013.01)

(58) Field of Classification Search
CPC ..... E02F 9/2825; E02F 9/2858; E02F 9/2883; E02F 9/2808; E02F 9/2816; E02F 9/2833; E02F 9/28; E02F 3/8152; E02F 3/8155; E02F 3/8157
USPC ..... 37/455
See application file for complete search history.

(56) References Cited

U.S. PATENT DOCUMENTS 3,530,601 A * 9/1970 Steil ..... E02F 9/2833 37/456
5,553,409 A * 9/1996 Irving ..... A01B 15/02 37/446
5,713,145 A * 2/1998 Ruvang ..... E02F 9/2833 37/458
5,987,787 A * 11/1999 Mack ..... E02F 9/2825 37/456
6,145,224 A * 11/2000 Stickling ..... E02F 9/2825 37/456
6,240,663 B1 * 6/2001 Robinson ..... E02F 9/2841 37/458
8,925,220 B2 * 1/2015 Stangeland ..... E02F 9/2825 37/452
8,959,807 B2 2/2015 LaHood et al.
9,988,795 B2 * 6/2018 Hooijmans ..... E02F 9/2808
10,294,638 B2 * 5/2019 Balan ..... E02F 9/2825
D858,584 S 9/2019 Balan et al.
(Continued)

FOREIGN PATENT DOCUMENTS

KR 20140145699 A 12/2014
KR 101815372 B1 1/2018

OTHER PUBLICATIONS

Database Compendex [Online] Engineering Information, Inc. , New York, NY, US; Jul. 2013 (Jul. 2013), Slavkovic R et al: "Simulation of the casting process—A powerful! tool for enhanced design of the cutting teeth in surface mining", XP09544299, Database accession No. E20130515979346 the whole document.
(Continued)

*Primary Examiner* — Christopher J Sebesta
*Assistant Examiner* — Audrey L Lusk

(57) ABSTRACT

A wear member includes a first leg, a second leg, and a throat portion connecting the first leg to the second leg. The first leg defines a first leg thickness, and the throat portion defines a throat portion thickness disposed adjacent to the first leg thickness. A ratio of the throat portion thickness to the first leg thickness ranges from 1.1 to 1.2.

20 Claims, 9 Drawing Sheets

(56) References Cited

U.S. PATENT DOCUMENTS

| | | | | |
|---|---|---|---|---|
| 10,947,704 | B2 | 3/2021 | Bjerke | |
| 2012/0297649 | A1 | 11/2012 | Gomar | |
| 2016/0369481 | A1* | 12/2016 | Hooijmans ..... | E02F 9/2858 |
| 2019/0063044 | A1 | 2/2019 | Balan et al. | |

OTHER PUBLICATIONS

Database Compendex [Online] Engineering Information, Inc., New York, NY, US; 1989, Gershtein GI et al: "Production of teeth for excavator scoops", XP009544300, Database accession No. EIX90110554268 the whole document.

* cited by examiner

GEOMETRIC PROFILE FOR IMPROVED MANUFACTURABILITY OF A GROUND ENGAGING TOOL

TECHNICAL FIELD

The present disclosure relates generally to the manufacturing process for producing a ground engaging tool. More specifically, the present disclosure relates to an improved geometric profile that enhances the manufacturability of a ground engaging tool.

BACKGROUND

Ground engaging tools, edge protectors, and shrouds, etc. (collectively may be referred to as wear members) are routinely used by machines in the earthmoving, mining, agricultural, and construction industries, etc. These components are typically manufactured from iron using a casting process as depicted in FIG. 1. More specifically, shrouds 50 are shown in FIG. 1 that are produced using side risers (also referred to as feeders since they provide material to the cavity in order to compensate for shrinkage). The use of side risers limits the number of cavities in the mold, reducing the productivity of the manufacturing process.

FIG. 2 depicts what happens if the side risers are eliminated in an attempt to increase the productivity of the manufacturing process. Particularly, the risk for porosity is increased to an undesirable level, producing a shroud that may crack in use, etc. Also, the current manufacturing process only has about a 50% yield rate, a 28% rework rate, and a 22% scrap due in part to the use of the side risers.

U.S. Pat. No. 10,294,638 B2 discloses a shroud that is configured to be attached to a work implement. The shroud may comprise a body defining a closed end, an open end, a first side surface and a second side surface. The first side surface and the second side surface span from the closed end to the open end. A working portion is disposed proximate the closed end, a first leg extends rearward from the working portion to the open end, and a second leg extends rearward from the working portion to the open end. The side surfaces also form the side surfaces of the legs. A throat portion connects the legs and working portion together. The first and second legs define a slot, the slot defining a direction of assembly onto a work implement and the body defines a Cartesian coordinate system wherein the X-axis is parallel with the direction of assembly. The working portion defines a ground engaging surface at the closed end that may comprise a convex arcuate portion intersecting with the X-axis, a first concave arcuate portion extending from the convex arcuate portion toward the first side surface, and a second concave arcuate portion extending from the convex arcuate portion toward the second side surface when the ground engaging surface is projected onto a X-Y plane along the Z-axis.

However, the '638 patent does not address the manufacturing process for making the shroud. Accordingly, a manufacturing process that increases productivity and yield rate is needed.

SUMMARY OF THE DISCLOSURE

A wear member that is configured to be attached to a work implement according to an embodiment of the present disclosure may comprise a first leg, a second leg, and a throat portion connecting the first leg to the second leg. The first leg may define a first leg thickness, and the throat portion may define a throat portion thickness disposed adjacent to the first leg thickness. A ratio of the throat portion thickness to the first leg thickness may range from 1.1 to 1.2.

A shroud that is configured to be attached to an edge of a work implement according to an embodiment of the present disclosure may comprise a top leg with a rear surface having a rear gate blemish, a bottom leg with a bottom surface having a bottom gate blemish, and a throat portion including a first beveled portion extending from the top leg, and a second beveled portion extending from the first beveled portion to the bottom leg. The top leg may define a first top leg thickness, and the first beveled portion may define a first beveled portion thickness that is greater than the top leg thickness.

A mold for casting a shroud according to an embodiment of the present disclosure may comprise a plurality of cavities, a sprue, and a feeder system connecting the sprue to the plurality of cavities. The feeder system includes a plurality of rear gates that are in fluid communication with the plurality of cavities, and the sprue.

DETAILED DESCRIPTION

Figure 1:
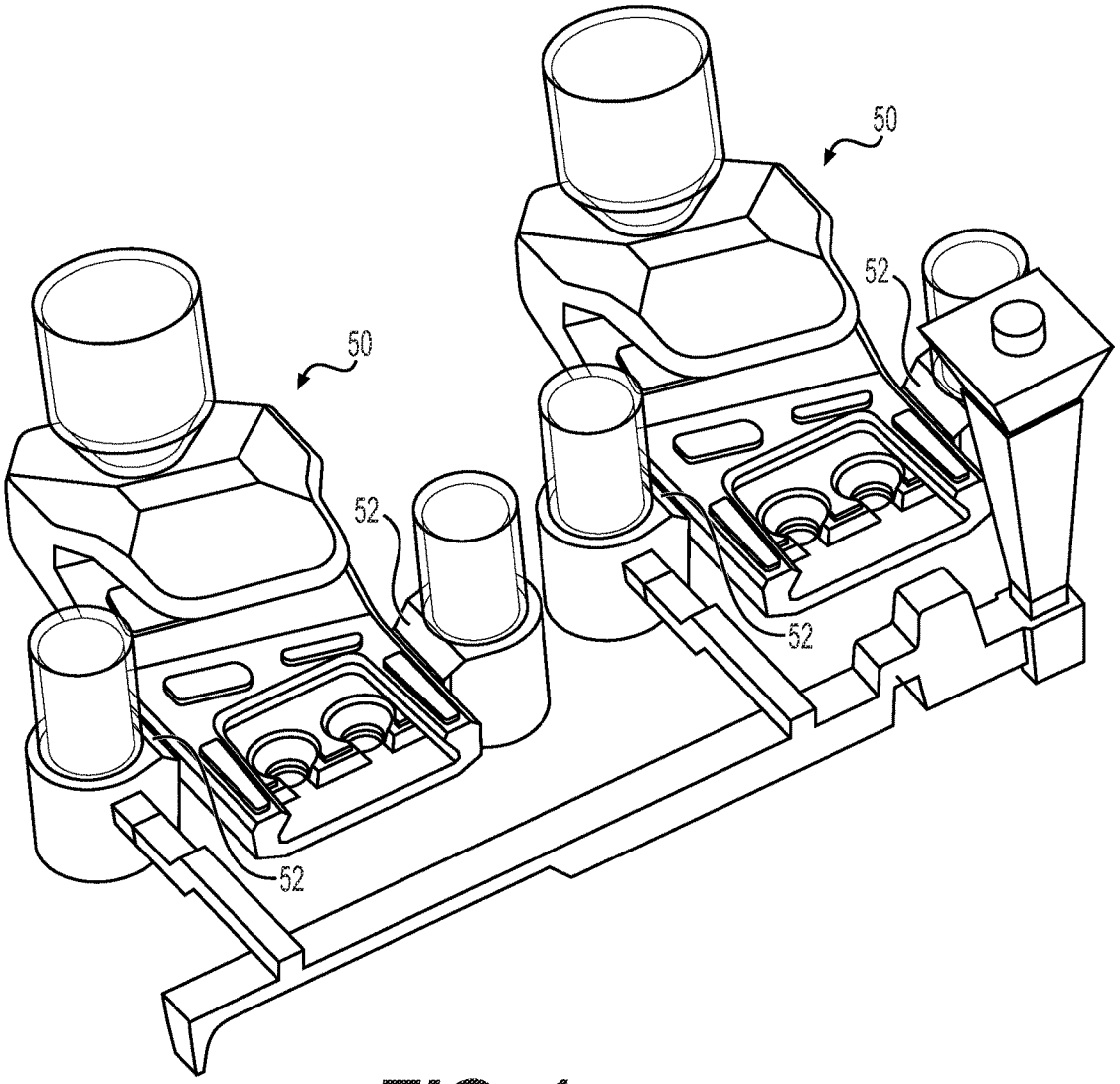
FIG. 1 PRIOR ART
FIG. 1 is a depiction of a casting process employing top and side risers to produce shrouds (a type of ground engaging tool) according to an example found in the prior art. The side risers and side gates limit number of cavities that produce the shrouds.
Figure 2:
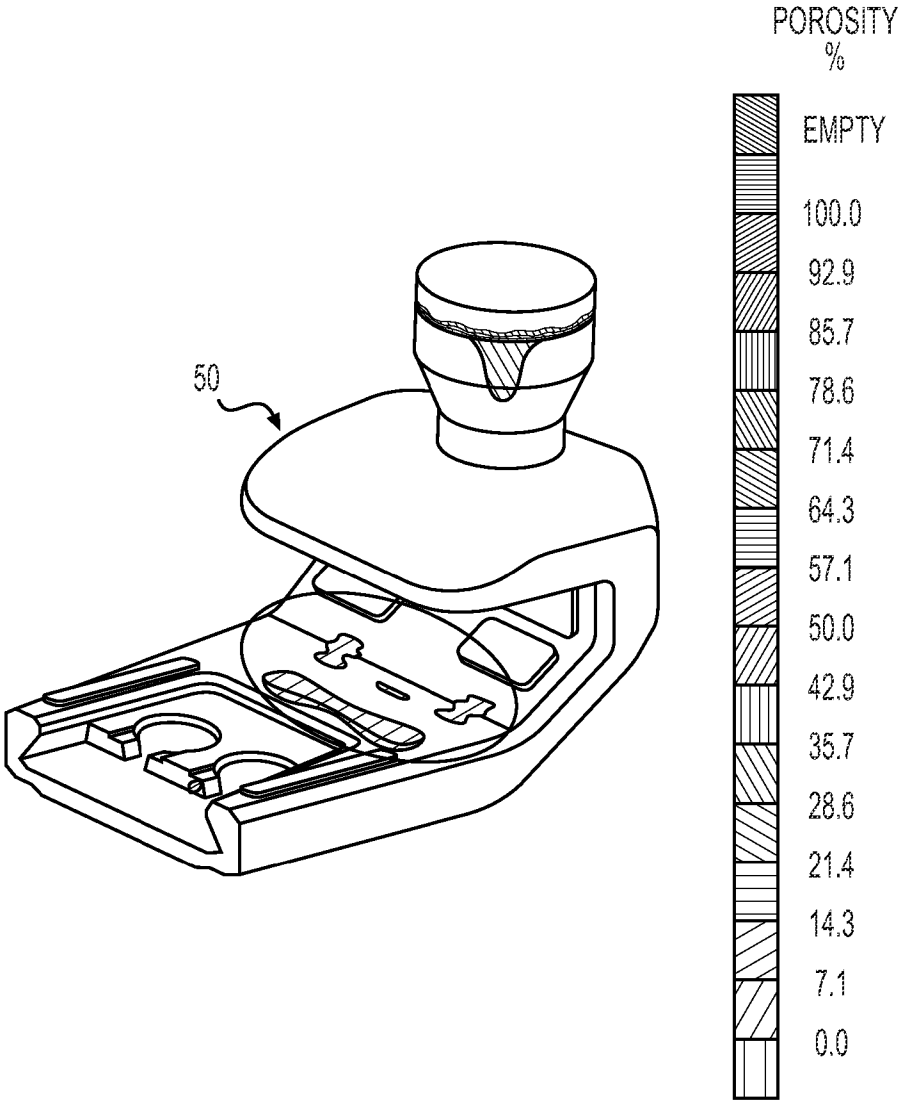
FIG. 2 is a plot created using FEA (finite element analysis), showing that if the side risers used in FIG. 1 are eliminated, a risk for porosity to develop in the shroud is increased.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

Various embodiments of a wear member or a shroud are disclosed that may improve the manufacturing process and increase the yield rate without adversely affecting the strength of the wear member or the shroud. More specifically, the profile geometry of the wear member or the shroud may allow such an improvement in the manufacturing process.

Figure 3:
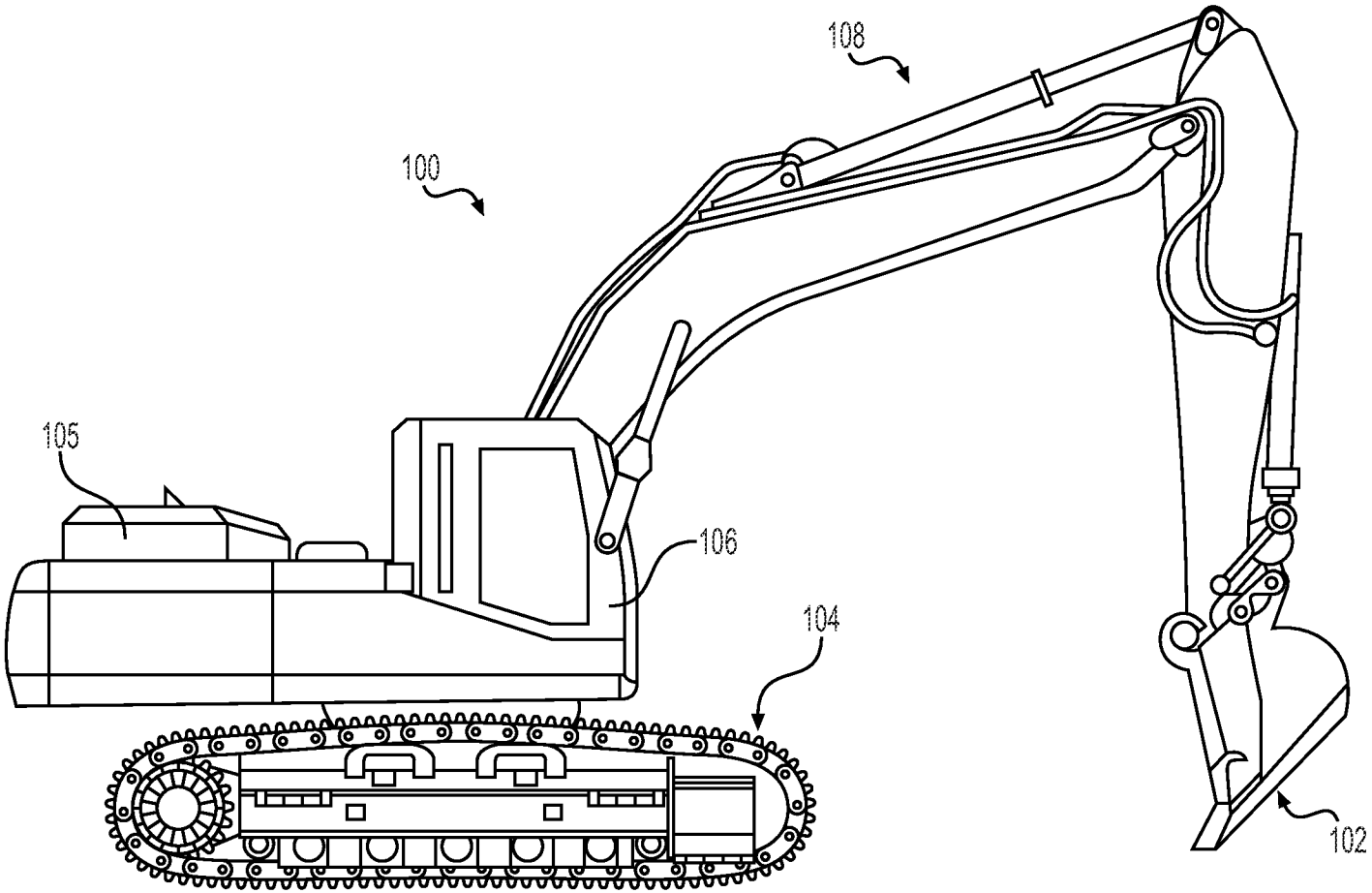
FIG. 3 is a perspective view of a machine such as an excavator using a bucket with shrouds configured according to an embodiment of the present disclosure.

FIG. 3 shows a machine 100 in the form of an excavator employing a bucket 102 to move dirt, rocks, etc. and that is propelled by a track system 104 and powered by an engine. A cab 106 is also provided to house an operator (not shown) for controlling the movement of the bucket via a stick and boom system 108. The bucket and machine may take different forms in various embodiments of the present disclosure as explained in the following paragraph.

Figure 4:
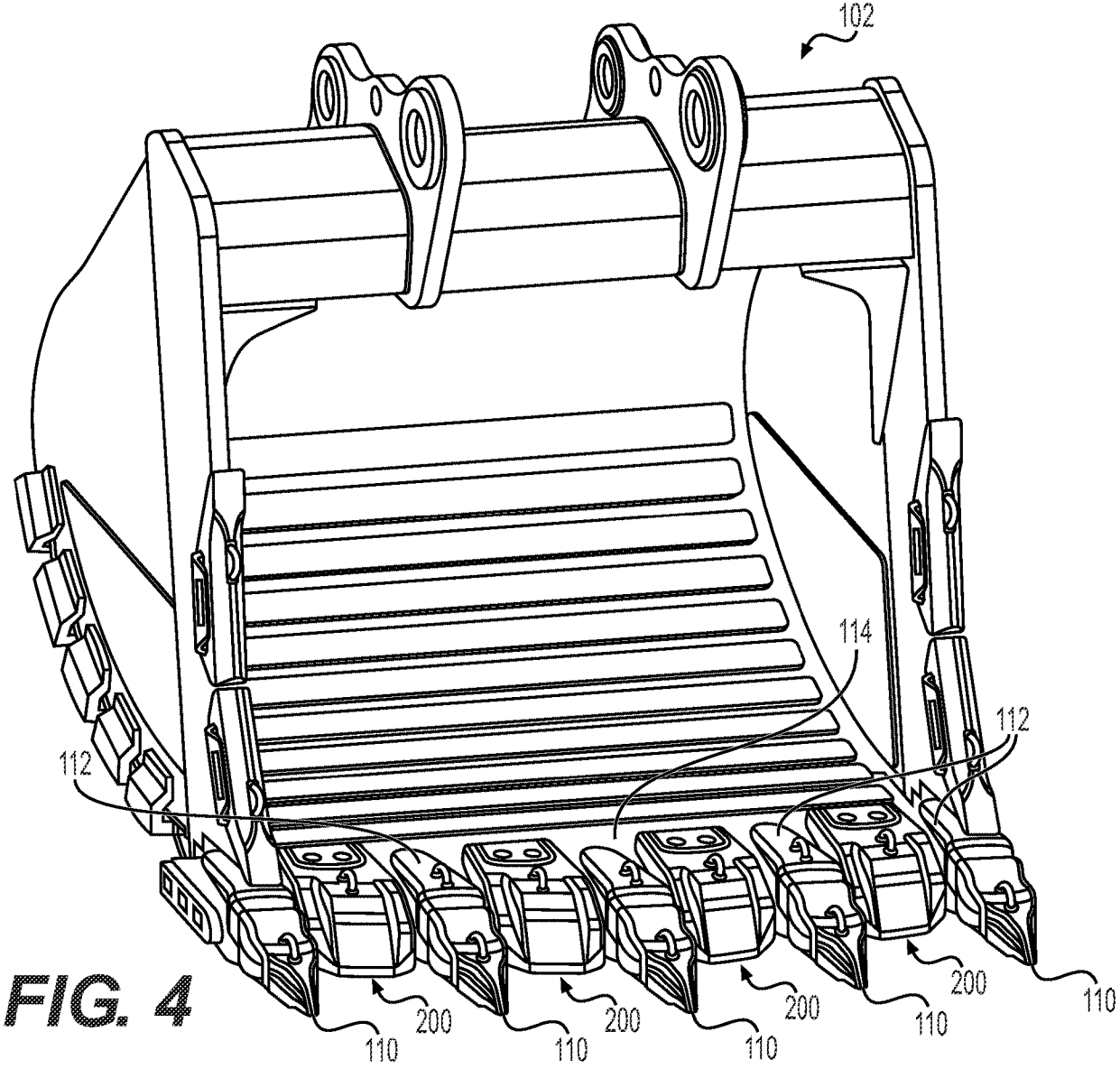
FIG. 4 is a front oriented perspective view of the bucket and shrouds of FIG. 3 shown in isolation from the machine.
Figure 5:
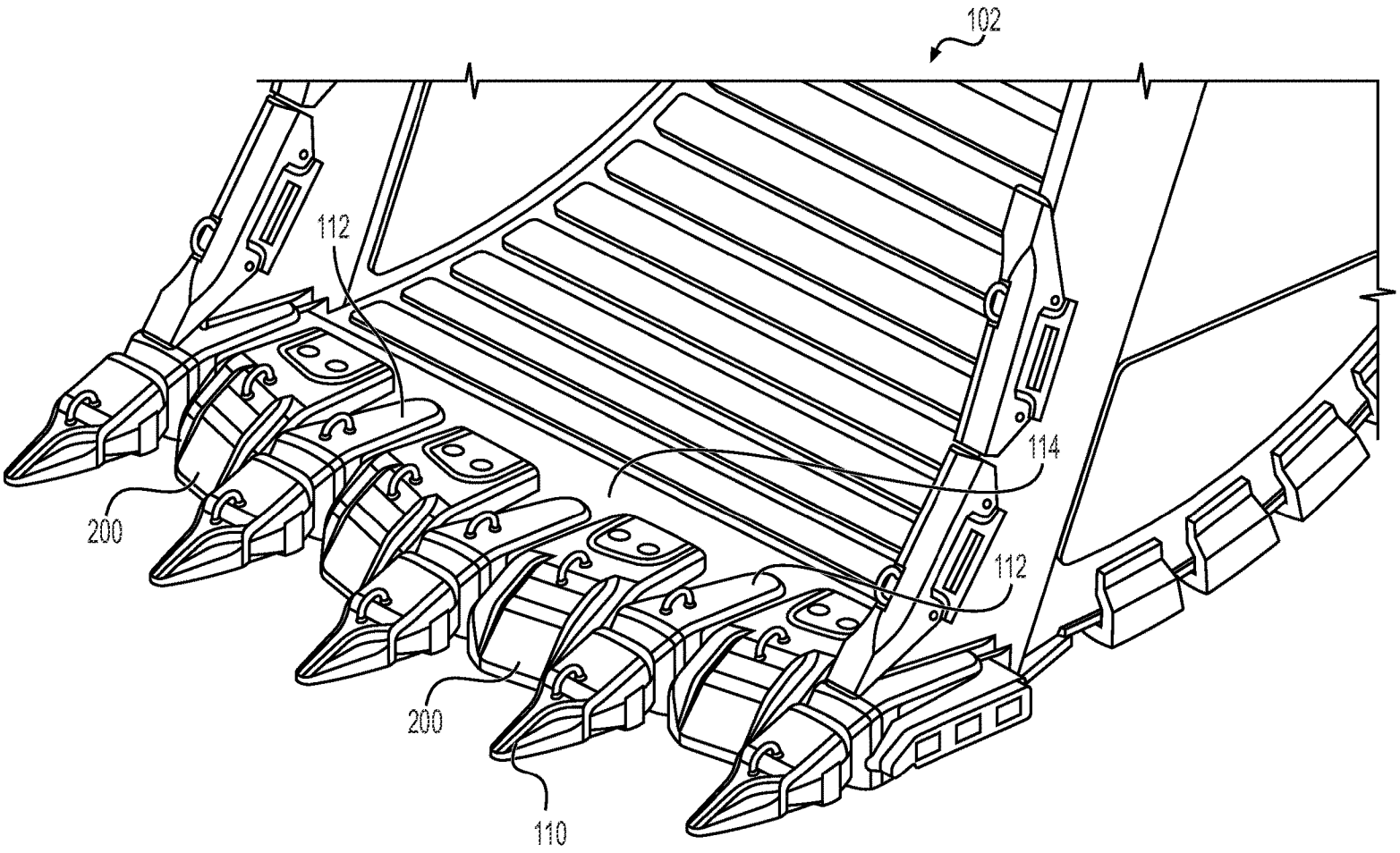
FIG. 5 is a side oriented perspective view of the bucket and shrouds of FIG. 4.

FIGS. 4 and 5 show that shrouds 200, tips 110, and adapters 112 may be attached to the front lip 114 of the bucket. The shrouds, tips, and adapters, etc. may be more generally characterized as "wear members" herein. It is also to be understood that other work implements other than buckets may employ wear members configured according to various embodiments of the present disclosure including shears, grapples, rippers, etc.

Figure 6:
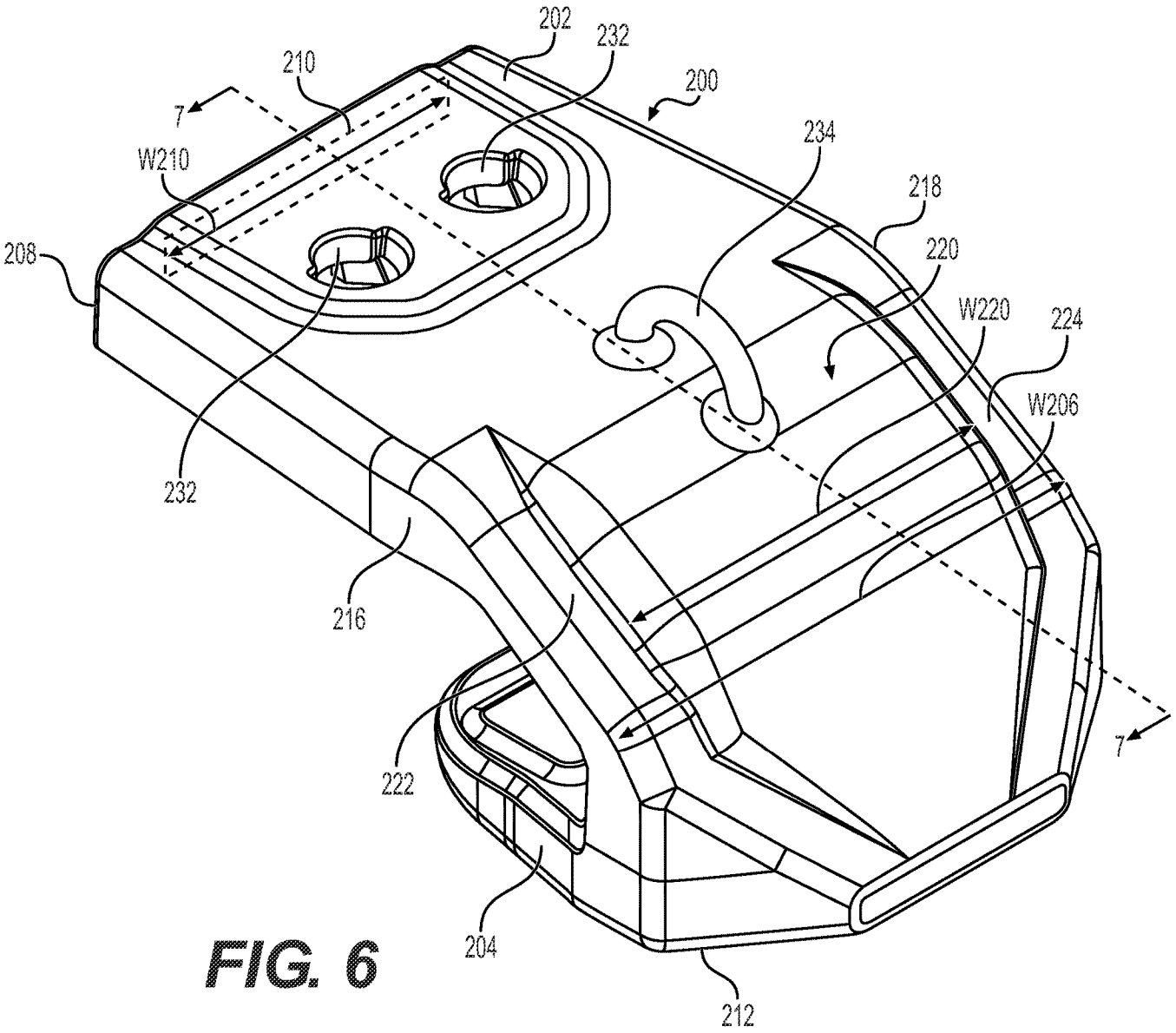
FIG. 6 is a perspective view of a shroud similar to that of FIG. 4 shown in isolation.

Looking now at FIGS. 5 and 6, such wear members (e.g., shroud 200) may comprise a first leg 202, a second leg 204, and a throat portion 206 that connects the first leg 202 to the second leg 204. The first leg 202 may define a first leg thickness T202, while the throat portion 206 may define a throat portion thickness T206 disposed immediately adjacent to the first leg thickness T202 (e.g. closer to the first leg than the second leg). A ratio of the throat portion thickness T206 to the first leg thickness T202 may range from 1.1 to 1.2 in some embodiments of the present disclosure. This slightly increased thickness in the throat portion may alleviate flow hesitation during the casting process, allowing a rear gate 302 to be employed in the mold 300 (see also FIG. 8) without increasing the risk of voids forming in the throat portion.

Figure 7:
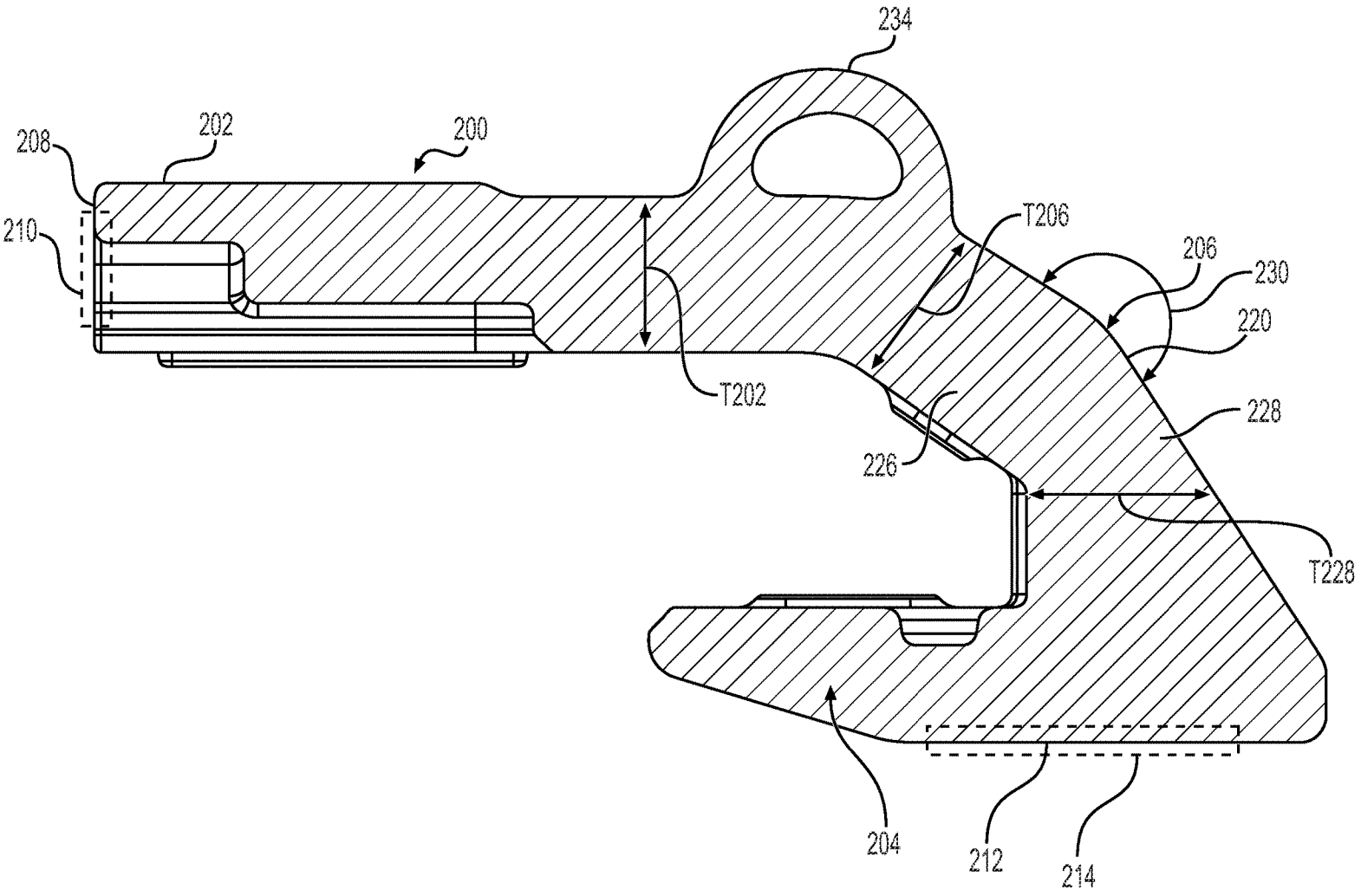
FIG. 7 is sectional view of the shroud of FIG. 6 taken along its midplane (represented by lines 7-7) in FIG. 6. The transitional portion or throat between the upper and lower legs of the shroud has an increased thickness, reducing flow hesitation.

Consequently as depicted in FIGS. 6 and 7, the first leg 202 may define a rear surface 208 with a rear gate blemish 210. The first leg 202 may take the form of a top leg that is longer than the second leg 204, which may take the form of a bottom leg that is shorter than the top leg. This may not be the case in other embodiments of the present disclosure. The second leg 204 may have a bottom surface 212 with a bottom gate blemish 214 that results from the top risers 304 shown in FIG. 8.

Again, the wear member may be a shroud 200, but not necessarily so. As best seen in FIG. 6, the first leg 202, the second leg 204, and the throat portion 206 may define a first lateral side 216, and a second lateral side 218. The throat portion 206 may include a rib 220 that is spaced away from the first lateral side 216, and the second lateral side 218, forming a first notch 222, and a second notch 224. As best seen in FIG. 7, the rib 220 at least partially defines the throat portion thickness T206. In other embodiments, the rib or added material extends completely to both lateral sides such that no notches are present, etc.

Referring to FIGS. 6 and 7, an embodiment of a shroud may be more specifically described as comprising a top leg (e.g., see first leg 202) with a rear surface 208 having a rear gate blemish 210, and a bottom leg (e.g. see second leg 204) with a bottom surface 212 having a bottom gate blemish. 214 The throat portion 206 may include a first beveled portion 226 that extends from the top leg, as well as a second beveled portion 228 that extends from the first beveled portion 226 at an oblique angle 230 (see FIG. 7) to the bottom leg. The top leg defines a first top leg thickness (e.g., see T202), and the first beveled portion defines a first beveled portion thickness (see throat portion thickness T206) that is greater than the top leg thickness. Moreover, the second beveled portion defines a second beveled portion thickness T228 that is greater than the first beveled portion thickness. As shown, the top leg thickness and the first beveled portion thickness are substantially constant, while the second beveled portion thickness varies. This may not be the case for other embodiments of the present disclosure.

As alluded to earlier herein with reference to FIG. 6, the throat portion may define a first lateral surface, and a second lateral surface that may lack gate blemishes since the side gates may be eliminated. A protrusion (e.g., see rib 220) may be spaced laterally away from the first lateral surface, and the second lateral surface, forming a first side recess (e.g., see first notch 222) and a second side recess (e.g., see second notch 224). As best understood with reference to FIG. 7, the protrusion at least partially defines the first beveled portion thickness (e.g., see T206), and the second beveled portion thickness (e.g., see T228). This may not be the case for other embodiments of the present disclosure.

As best seen in FIG. 6, the top leg defines at least a first retaining mechanism receiving aperture 232. Also, a lifting eye 234 extends from the first beveled portion to the top leg. Other positions are possible or the lifting eye, and these features may be omitted in other embodiments of the present disclosure, etc.

The shroud that is shown is a center shroud as evidenced by its symmetry about its lateral midplane (or cross-sectioned plane of FIG. 7). However, the inventor has also simulated that the shroud could also be a left shroud or a right shroud that are asymmetrical about the lateral midplane (similar to what is shown in FIGS. 19 and 21 of U.S. Pat. No. 10,724,212 B2, or FIGS. 1, 4 and 5 of the present application).

Still referring to FIG. 6, the protrusion defines a protrusion lateral width W220, and the throat portion defines a throat portion lateral width W206. A ratio of the protrusion lateral width to the throat portion lateral width may range from 0.5 to 0.9 in some embodiments of the present disclosure. Likewise, the rear gate blemish may define a rear gate blemish lateral width W210, and a ratio of the rear gate blemish lateral width to the throat portion lateral width W206 may be greater than 0.25. In some embodiments, this ratio may be greater than 0.35 (e.g., may be approximately 0.4 in some embodiments).

The configuration, ratios and dimensional ranges of any of the features of any of the embodiments discussed herein may be altered to be different than what has been explicitly discussed or shown depending on the application.

INDUSTRIAL APPLICABILITY

In practice, a wear member, or a shroud according to any embodiment described herein may be provided, sold, manufactured, and bought etc. as needed or desired in an aftermarket or OEM (original equipment manufacturer) context. For example, a wear member or a shroud may be used to retrofit a work implement already in the field or may be sold with a piece of equipment (e.g., a machine such as an excavator, a wheel loader, etc.) using that work implement at the first point of sale of the piece of equipment.

The wear member or shroud may be fabricated from iron, cast-iron, steel, or gray-cast iron or other suitable material that is durable, and that can be used in the casting process. The geometry of the wear member or shroud may be formed during the casting, and then may be rough machined and/or finish machined if necessary. Suitable machining processes may include milling, turning, electrical discharge machining, etc. The wear member may be separated from the top risers and the rear gates, forming a gate blemish that may be proud, recessed, or some combination of proud and recessed relative to the exterior surface of the wear member or shroud. The gate blemish may be removed by machining, etc.

Figure 8:
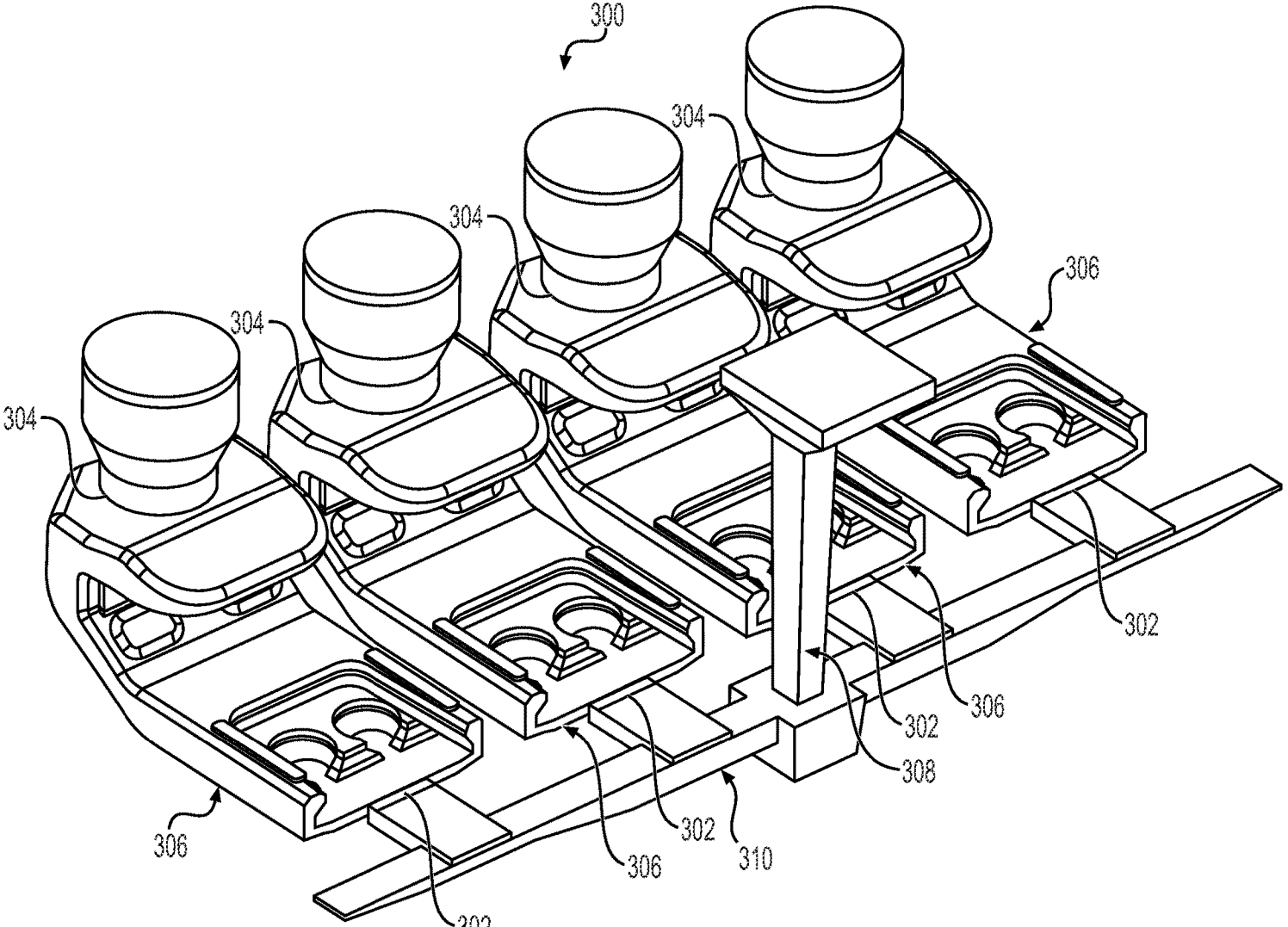
FIG. 8 is a depiction of a casting process employing only top risers and a single rear gate to produce the shroud of FIG. 7, allowing the number of cavities of the mold to be increased.
Figure 9:
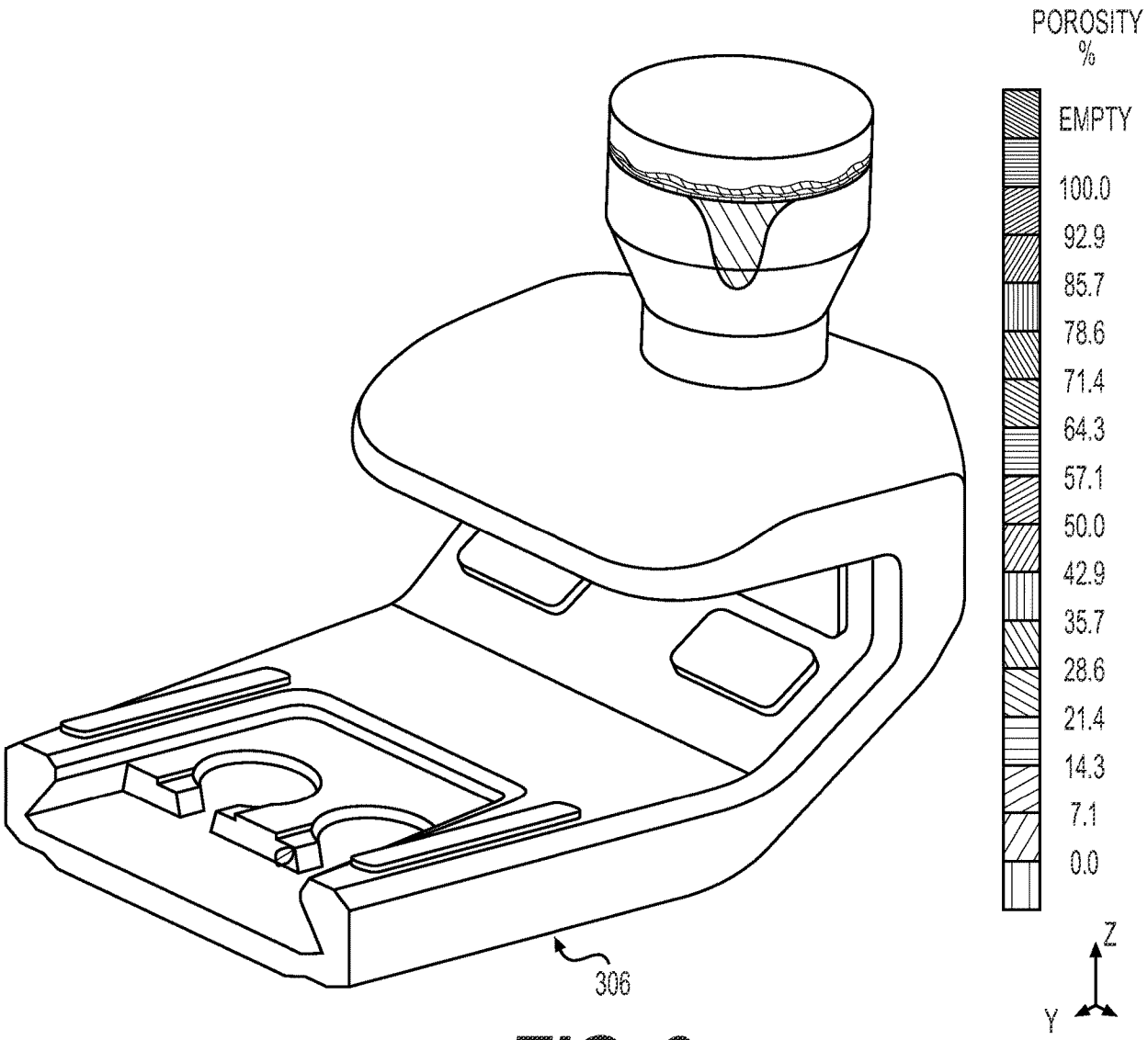
FIG. 9 is a plot created using FEA, showing that elimination of the side risers/side gates does not increase the risk of porosity for the shroud of FIG. 6.

FIGS. 8 and 9 show that the change in thickness of the throat portion allows the side gates to be eliminated and a single rear gate to be employed, allowing for more cavities, increasing the yield rate without increasing the risk for porosity.

More specifically FIG. 8 illustrates a mold 300 for casting a shroud (or other wear member). The mold 300 may comprise a plurality of cavities 306, a sprue 308, and a feeder system 310 (may also be referred to as a spider or runner system) connecting the sprue to the plurality of cavities. A plurality of rear gates 302 that are in fluid communication with the plurality of cavities, and the sprue as well as top risers 304 are also shown.

In some embodiments, each of the plurality of cavities is connected to the feeder system by a single rear gate of the plurality of rear gates, and each of the plurality of cavities is in fluid communication with a top riser. This may not be the case for other embodiments of the present disclosure.

It is to be understood that the mold would actually be the negative image of the cast components (may also be referred to as a "shot") shown in FIG. 8.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A wear member configured to be attached to a work implement, the wear member comprising:

a first leg;

a second leg; and a throat portion connecting the first leg to the second leg;

wherein a first portion of the first leg extends from a rear surface defined by the first leg, wherein a second portion of the first leg extends from an end of the second leg and to the first portion of the first leg, wherein the second leg extends from the end of the second leg and to the throat portion, wherein a third portion of the first leg extends from the second portion of the first leg and to the throat portion, wherein a combined length of the first portion of the first leg and the second portion of the first leg is longer than a length of the third portion of the first leg, wherein the first portion of the first leg includes a projection that extends to the rear surface, that projects above a topmost surface of the second portion of the first leg, and that extends laterally across a midplane of the wear member, wherein the first leg defines a first leg thickness, wherein the throat portion defines a throat portion thickness disposed adjacent to the first leg thickness, and wherein a ratio of the throat portion thickness to the first leg thickness ranges from 1.1 to 1.2; and a lifting eye extending from the throat portion to the first portion of the first leg.

2. The wear member of claim 1, wherein the rear surface includes a rear gate blemish.

3. The wear member of claim 1, wherein the first leg is a top leg and is longer than the second leg.

4. The wear member of claim 1, wherein the second leg defines a bottom surface with a bottom gate blemish.

5. The wear member of claim 1, wherein the second leg is a bottom leg and is shorter than the first leg.

6. The wear member of claim 1, wherein the wear member is a shroud, wherein the first leg, the second leg, and the throat portion define a first lateral side and a second lateral side, and wherein the throat portion includes a rib that is spaced away from the first lateral side, and the second lateral side, forming a first notch and a second notch.

7. The wear member of claim 6, wherein the rib at least partially defines the throat portion thickness.

8. A shroud configured to be attached to an edge of a work implement, the shroud comprising:

a top leg with a rear surface having a rear gate blemish;

a bottom leg with a bottom surface having a bottom gate blemish; and a throat portion including:

a first beveled portion extending from the top leg, a second beveled portion extending from the first beveled portion to the bottom leg, and a rib that is spaced away from a first lateral side of the throat portion and a second lateral side of the throat portion, wherein a first portion of the top leg extends from the rear surface, wherein a second portion of the top leg extends from beyond an end of the bottom leg and to the first portion of the top leg, wherein the bottom leg extends from the end of the bottom leg and to the second beveled portion, wherein a third portion of the top leg extends from the second portion of the top leg and to the first beveled portion, wherein a combined length of the first portion of the top leg and the second portion of the top leg is longer than a length of the third portion of the top leg, wherein the second portion of the top leg defines a top leg thickness, wherein the first beveled portion defines a first beveled portion thickness that is greater than the top leg thickness, and wherein the first portion of the top leg includes a projection that projects above a topmost surface of the second portion of the top leg, that extends to the rear surface, and that extends laterally across a midplane of the shroud.

9. The shroud of claim 8, wherein the second beveled portion defines a second beveled portion thickness that is greater than the first beveled portion thickness.

10. The shroud of claim 9, wherein the throat portion defines a first lateral surface and a second lateral surface, and wherein the throat portion includes a protrusion that is spaced laterally away from the first lateral surface and the second lateral surface, forming a first side recess and a second side recess.

11. The shroud of claim 10, wherein the protrusion at least partially defines the first beveled portion thickness and the second beveled portion thickness.

12. The shroud of claim 8, wherein the top leg defines at least a first retaining mechanism receiving aperture.

13. The shroud of claim 8, further comprising a lifting eye extending from the first beveled portion to the top leg.

14. The shroud of claim 8, wherein the shroud is a center shroud.

15. The shroud of claim 10, wherein the first lateral side and the second lateral side lack a gate blemish that is caused by side gates used to produce shrouds.

16. The shroud of claim 10, wherein the protrusion defines a protrusion lateral width, wherein the throat portion defines a throat portion lateral width, and wherein a ratio of the protrusion lateral width to the throat portion lateral width ranges from 0.5 to 0.9.

17. The shroud of claim 16, wherein the rear gate blemish defines a rear gate blemish lateral width, and wherein a ratio of the rear gate blemish lateral width to the throat portion lateral width is greater than 0.25.

18. A wear member configured to be attached to a work implement, the wear member comprising:

a first leg;

a second leg; and a throat portion connecting the first leg to the second leg, wherein a first portion of the first leg extends from a rear surface defined by the first leg, wherein a second portion of the first leg extends from beyond an end of the second leg and to the first portion of the first leg, wherein the second leg extends from the end of the second leg and to the throat portion, wherein third portion of the first leg extends from the second portion of the first leg and to the throat portion, wherein the first portion of the first leg includes a projection that extends to the rear surface, that projects above a topmost surface of the second portion of the first leg, and that extends laterally across a midplane of the wear member, and wherein the throat portion includes:

a first beveled portion extending from the first leg, a second beveled portion extending from the first beveled portion to the second leg, and a rib that is spaced away from a first lateral side of the throat portion and a second lateral side of the throat portion.

19. The wear member of claim 18, wherein the first leg defines a first leg thickness, wherein the throat portion defines a throat portion thickness, and wherein a ratio of the throat portion thickness to the first leg thickness ranges from 1.1 to 1.2.

20. The shroud of claim 8, wherein the top leg thickness is substantially constant, wherein the first beveled portion is substantially constant, and wherein the shroud further comprises:

a lifting eye that extends from the throat portion to the first portion of the top leg.

* * * * *